US010350731B2

(12) United States Patent
Eyre et al.

(10) Patent No.: US 10,350,731 B2
(45) Date of Patent: Jul. 16, 2019

(54) THERMALLY STABLE DIAMOND POLYCRYSTALLINE DIAMOND CONSTRUCTIONS

(71) Applicant: Smith International, Inc., Houston, TX (US)

(72) Inventors: Ronald K. Eyre, Orem, UT (US); Anthony Griffo, The Woodlands, TX (US); Thomas W. Oldham, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 1140 days.

(21) Appl. No.: 14/062,533

(22) Filed: Oct. 24, 2013

(65) Prior Publication Data

US 2014/0182215 A1 Jul. 3, 2014

Related U.S. Application Data

(60) Continuation of application No. 12/820,518, filed on Jun. 22, 2010, now Pat. No. 9,931,732, which is a (Continued)

(51) Int. Cl.
*B24D 3/10* (2006.01)
*C22C 26/00* (2006.01)
(Continued)

(52) U.S. Cl.
CPC ..... *B24D 3/10* (2013.01); *C22C 26/00* (2013.01); *E21B 10/567* (2013.01);
(Continued)

(58) Field of Classification Search
CPC ..... B22F 2998/00; B22F 2207/03; B22F 2003/244; B22F 2005/001; B24D 3/10;
(Continued)

(56) References Cited

U.S. PATENT DOCUMENTS 3,136,615 A 6/1964 Bovenkerk
3,141,746 A 7/1964 DeLai
(Continued)

FOREIGN PATENT DOCUMENTS

EP 0300699 A2 1/1989
EP 0329954 A2 8/1989
(Continued)

OTHER PUBLICATIONS

Non-Final Office Action issued in related U.S. Appl. No. 12/820,518, dated Apr. 22, 2015 (17 pages).
(Continued)

*Primary Examiner* — Shuangyi Abu Ali
(74) *Attorney, Agent, or Firm* — Osha Liang LLP

(57) ABSTRACT

Thermally stable diamond constructions comprise a diamond body having a plurality of bonded diamond crystals, a plurality of interstitial regions disposed among the crystals, and a substrate attached to the body. The body includes a working surface and a side surface extending away from the working surface to the substrate. The body comprises a first region adjacent the side surface that is substantially free of a catalyst material and that extends a partial depth into the diamond body. The first region can further extend to at least a portion of the working surface and a partial depth therefrom into the diamond body. The diamond body can be formed from natural diamond grains and/or a mixture of natural and synthetic diamond grains. A surface of the diamond body is treated to provide the first region, and before treatment is finished to an approximate final dimension.

20 Claims, 9 Drawing Sheets

Related U.S. Application Data continuation of application No. 11/776,425, filed on Jul. 11, 2007, now Pat. No. 7,740,673, which is a division of application No. 11/022,271, filed on Dec. 22, 2004, now Pat. No. 7,608,333, which is a continuation-in-part of application No. 10/947,075, filed on Sep. 21, 2004, now Pat. No. 7,754,333.

(51) Int. Cl.
*E21B 10/567* (2006.01)
*B22F 3/24* (2006.01)
*B22F 5/00* (2006.01)

(52) U.S. Cl.
CPC ... *B22F 2003/244* (2013.01); *B22F 2005/001* (2013.01); *B22F 2998/00* (2013.01); *Y10T 407/27* (2015.01); *Y10T 428/24488* (2015.01); *Y10T 428/24612* (2015.01); *Y10T 428/26* (2015.01); *Y10T 428/30* (2015.01); *Y10T 428/31678* (2015.04)

(58) Field of Classification Search
CPC ..... C22C 26/00; E21B 10/567; Y10T 407/27; Y10T 428/24488; Y10T 428/24612; Y10T 428/26; Y10T 428/30; Y10T 428/31678
See application file for complete search history.

(56) References Cited

U.S. PATENT DOCUMENTS 3,190,749 A 6/1965 Fleming
3,233,988 A 2/1966 Wentorf
3,745,623 A 7/1973 Wentorf, Jr. et al.
4,104,344 A 8/1978 Pope et al.
4,108,614 A 8/1978 Mitchell
4,151,686 A 5/1979 Lee et al.
4,163,769 A 8/1979 Pope et al.
4,224,380 A 9/1980 Bovenkerk et al.
4,255,165 A 3/1981 Dennis et al.
4,268,276 A 5/1981 Bovenkerk
4,288,248 A 9/1981 Bovenkerk et al.
4,303,442 A 12/1981 Hara et al.
4,311,490 A 1/1982 Bovenkerk et al.
4,373,593 A 2/1983 Phaal et al.
4,387,287 A 6/1983 Marazzi
4,412,980 A 11/1983 Tsuji et al.
4,481,016 A 11/1984 Campbell et al.
4,486,286 A 12/1984 Lewin et al.
4,504,519 A 3/1985 Zelez
4,522,633 A 6/1985 Dyer
4,525,179 A 6/1985 Gigl
4,534,773 A 8/1985 Phaal et al.
4,556,403 A 12/1985 Almond et al.
4,560,014 A 12/1985 Geczy
4,570,726 A 2/1986 Hall
4,572,722 A 2/1986 Dyer
4,604,106 A 8/1986 Hall
4,605,343 A 8/1986 Hibbs, Jr. et al.
4,606,738 A 8/1986 Hayden
4,621,031 A 11/1986 Scruggs
4,629,373 A 12/1986 Hall
4,636,253 A 1/1987 Nakai et al.
4,645,977 A 2/1987 Kurokawa et al.
4,662,348 A 5/1987 Hall et al.
4,664,705 A * 5/1987 Horton ..... B01J 3/062 264/125
4,670,025 A 6/1987 Pipkin
4,707,384 A 11/1987 Schachner et al.
4,726,718 A 2/1988 Meskin et al.
4,766,040 A 8/1988 Hillert et al.
4,776,861 A 10/1988 Frushour
4,784,023 A 11/1988 Dennis
4,792,001 A 12/1988 Zijsling
4,793,828 A 12/1988 Burnand
4,797,241 A 1/1989 Peterson et al.
4,802,539 A 2/1989 Hall et al.
4,807,402 A 2/1989 Rai
4,828,582 A 5/1989 Frushour
4,844,185 A 7/1989 Newton, Jr. et al.
4,861,350 A 8/1989 Phaal et al.
4,871,377 A 10/1989 Frushour
4,899,922 A 2/1990 Slutz et al.
4,919,220 A 4/1990 Fuller et al.
4,940,180 A 7/1990 Martell
4,943,488 A 7/1990 Sung et al.
4,944,772 A 7/1990 Cho
4,976,324 A 12/1990 Tibbitts
5,011,514 A 4/1991 Cho et al.
5,027,912 A 7/1991 Juergens
5,030,276 A 7/1991 Sung et al.
5,092,687 A 3/1992 Hall
5,116,568 A 5/1992 Sung et al.
5,120,327 A 6/1992 Dennis
5,127,923 A 7/1992 Bunting et al.
5,135,061 A 8/1992 Newton, Jr.
5,176,720 A 1/1993 Martell et al.
5,186,725 A 2/1993 Martell et al.
5,199,832 A 4/1993 Meskin et al.
5,205,684 A 4/1993 Meskin et al.
5,213,248 A 5/1993 Horton et al.
5,238,074 A 8/1993 Tibbitts et al.
5,264,283 A 11/1993 Waldenstrom et al.
5,337,844 A 8/1994 Tibbitts
5,370,195 A 12/1994 Keshavan et al.
5,379,853 A 1/1995 Lockwood et al.
5,382,314 A 1/1995 Jin
5,439,492 A 8/1995 Anthony et al.
5,464,068 A 11/1995 Najafi-Sani
5,468,268 A 11/1995 Tank et al.
5,496,638 A 3/1996 Waldenstrom et al.
5,499,688 A 3/1996 Dennis
5,500,157 A 3/1996 Graebner et al.
5,505,748 A 4/1996 Tank et al.
5,510,193 A 4/1996 Cerutti et al.
5,523,121 A 6/1996 Anthony et al.
5,524,719 A 6/1996 Dennis
5,544,713 A 8/1996 Dennis
5,560,716 A 10/1996 Tank et al.
5,601,477 A 2/1997 Bunting et al.
5,607,024 A 3/1997 Keith et al.
5,620,382 A 4/1997 Cho et al.
5,624,068 A 4/1997 Waldenstrom et al.
5,630,479 A 5/1997 Dennis
5,645,617 A 7/1997 Frushour
5,665,252 A 9/1997 Jin et al.
5,667,028 A 9/1997 Truax et al.
5,706,906 A 1/1998 Jurewicz et al.
5,718,948 A 2/1998 Ederyd et al.
5,722,499 A 3/1998 Nguyen et al.
5,776,615 A 7/1998 Wong et al.
5,803,196 A 9/1998 Fielder
5,833,021 A 11/1998 Mensa-Wilmot et al.
5,890,552 A 4/1999 Scott et al.
5,897,942 A 4/1999 Karner et al.
5,954,147 A 9/1999 Overstreet et al.
5,979,578 A 11/1999 Packer
5,979,579 A 11/1999 Jurewicz
6,006,846 A 12/1999 Tibbitts et al.
6,009,963 A 1/2000 Chaves et al.
6,050,354 A 4/2000 Pessier et al.
6,063,333 A 5/2000 Dennis
6,102,143 A 8/2000 Snyder et al.
6,123,612 A 9/2000 Goers
6,126,741 A 10/2000 Jones et al.
6,149,695 A 11/2000 Adia et al.
6,189,634 B1 2/2001 Bertagnolli et al.
6,234,261 B1 5/2001 Evans et al.
6,248,447 B1 6/2001 Griffin et al.
6,253,864 B1 7/2001 Hall
6,269,894 B1 8/2001 Griffin
6,332,503 B1 12/2001 Pessier et al.
6,344,149 B1 2/2002 Oles
6,397,958 B1 6/2002 Charles et al.

(56) References Cited

U.S. PATENT DOCUMENTS

| | | | | |
|---|---|---|---|---|
| 6,408,959 | B2 | 6/2002 | Bertagnolli et al. | |
| 6,410,085 | B1 | 6/2002 | Griffin et al. | |
| 6,435,058 | B1 | 8/2002 | Matthias et al. | |
| 6,544,308 | B2 | 4/2003 | Griffin et al. | |
| 6,585,064 | B2 | 7/2003 | Griffin et al. | |
| 6,592,985 | B2 * | 7/2003 | Griffin | E21B 10/567 428/212 |
| 6,601,662 | B2 | 8/2003 | Matthias et al. | |
| 6,749,033 | B2 | 6/2004 | Griffin et al. | |
| 6,878,447 | B2 | 4/2005 | Griffin | |
| 7,517,589 | B2 | 4/2009 | Eyre | |
| 7,608,333 | B2 | 10/2009 | Eyre | |
| 7,754,333 | B2 | 7/2010 | Eyre et al. | |
| 8,028,771 | B2 | 10/2011 | Keshavan et al. | |
| 8,147,572 | B2 | 4/2012 | Eyre et al. | |
| 2001/0037901 | A1 | 11/2001 | Bertagnolli et al. | |
| 2002/0023733 | A1 * | 2/2002 | Hall | H01L 23/473 165/80.3 |
| 2005/0139397 | A1 | 6/2005 | Achilles et al. | |
| 2006/0042171 | A1 | 3/2006 | Radtke et al. | |
| 2006/0086540 | A1 | 4/2006 | Griffin et al. | |
| 2007/0181348 | A1 | 8/2007 | Lancaster et al. | |

FOREIGN PATENT DOCUMENTS

| | | | |
|---|---|---|---|
| EP | 0585631 | A1 | 3/1994 |
| EP | 0617207 | A2 | 9/1994 |
| EP | 0787820 | A2 | 8/1997 |
| EP | 0500253 | B1 | 11/1997 |
| EP | 0595630 | B1 | 1/1998 |
| EP | 0612868 | B1 | 7/1998 |
| EP | 0860515 | A1 | 8/1998 |
| EP | 1190791 | A2 | 3/2002 |
| GB | 1349385 | A | 4/1974 |
| GB | 2048927 | A | 12/1980 |
| GB | 2268768 | A | 1/1994 |
| GB | 2323398 | A | 9/1998 |
| RU | 2034937 | C1 | 5/1995 |
| SU | 566439 | | 1/2000 |
| WO | 9323204 | A1 | 11/1993 |
| WO | 9634131 | A1 | 10/1996 |
| WO | 00/28106 | A1 | 5/2000 |
| WO | 2004040095 | A1 | 5/2004 |
| WO | 2004106003 | A1 | 12/2004 |
| WO | 2004106004 | A1 | 12/2004 |
| WO | 2005/110648 | A2 | 11/2005 |

OTHER PUBLICATIONS

Declaration of Stephen C. Steinke.
Field Trial Report for Smith Test Bits with Partially Leached Cutters Occurring on or before Dec. 22, 2003.
U.S. Office Action issued in U.S. Appl. No. 11/776,425 dated Aug. 5, 2008 (12 pages).
Declaration of John L. Williams.
Declaration of Anthony Griffo.
Declaration of Ronald K. Eyre.
Declaration of Stewart Middlemiss.
U.S. Office Action issued in U.S. Appl. No. 10/947,075 dated Aug. 1, 2008 (6 pages).
U.S. Office Action issued in U.S. Appl. No. 11/022,271 dated Oct. 21, 2008 (4 pages).
U.S. Office Action issued in U.S. Appl. No. 11/022,272 dated May 30, 2008 (6 pages).
U.S. Office Action issued in U.S. Appl. No. 11/776,425 dated May 7, 2009 (12 pages).
UK Examination Report issued in Application GB0519211.7 dated Apr. 30, 2009 (3 pages).
U.S. Office Action issued in U.S. Appl. No. 10/947,075 dated Aug. 20, 2009 (6 pages).
Examination Report for United Kingdom Application No. GB1001703.6, dated Feb. 25, 2010 (6 pages).
Examination Report for United Kingdom Application No. GB1001698.8, dated Feb. 25, 2010 (6 pages).
Examination Report for United Kingdom Application No. GB1001690.5, dated Feb. 25, 2010 (6 pages).
Examination Report for United Kingdom Application No. GB1001691.3, dated Feb. 25, 2010 (6 pages).
Examination Report for United Kingdom Application No. GB0519211.7, dated Nov. 17, 2009 (2 pages).
Examination Report for United Kingdom Application No. GB0519211.7, dated Apr. 23, 2010 (2 pages).
Examination Report issued in United Kingdom Application No. GB1001691.3 dated Jun. 17, 2010 (1 page).
Examination Report issued in United Kingdom Application No. GB1001703.6 dated Jun. 17, 2010 (1 page).
Official Letter issued in Irish Application No. 2005/0623 dated Dec. 1, 2010 (1 page).
Office Action issued in the corresponding Canadian Application No. 2,520,319 dated Dec. 30, 2010 (3 pages).
Office Action issued in U.S. Appl. No. 11/776,389 dated Apr. 14, 2011 (58 pages).
Office Action issued in corresponding Canadian Application No. 2,520,319 dated Nov. 2, 2011 (2 pages).
Notice of Allowance issued in corresponding U.S. Appl. No. 11/776,389 dated Nov. 29, 2011 (11 pages).
Examination Report issued in corresponding Canadian Application No. 2,520,319 dated Jun. 18, 2012 (3 pages).
Office Action for Irish Application No. 2012/0262 dated Jan. 29, 2013 (7 pages).
Office Action for U.S. Appl. No. 13/408,503 dated Apr. 17, 2013 (8 pages).
Office Action issued in corresponding Canadian Application No. 2,520,319 dated Jun. 18, 2013 (3 pages).
Office action dated May 9, 2008, for related U.S. Appl. No. 11/022,271.
Office Action dated Aug. 8, 2007 for related U.S. Appl. No. 11/022,271.
Office Action dated Apr. 3, 2007 for related U.S. Appl. No. 11/022,272.
Office Action dated Oct. 4, 2007 for related U.S. Appl. No. 11/022,272.
Translation of Japanese Unexamined Patent Application No. S59-219500. "Diamond Sintering and Processing Method", Shuji Yatsu and Tetsuo Nakai, inventors; Application published Dec. 10, 1984; Applicant: Sumitomo Electric Industries Co. Ltd. Office Action by USPTO dated Mar. 11, 2003 for related U.S. Appl. No. 10/065,604.
Office Action dated May 9, 2008 for related U.S. Appl. No. 10/947,075.
Office Action dated Oct. 23, 2007 for related U.S. Appl. No. 10/947,075.
U.S. Patent and Trademark Office Action, dated Apr. 3, 2007, which has issued for U.S. Appl. No. 10/022,272, filed Dec. 22, 2004.
Office Action dated May 15, 2008 for related U.S. Appl. No. 10/947,075.
Final Office Action issued in related U.S. Appl. No. 12/820,518, dated Dec. 30, 2015 (20 pages).

* cited by examiner

FIG. 10
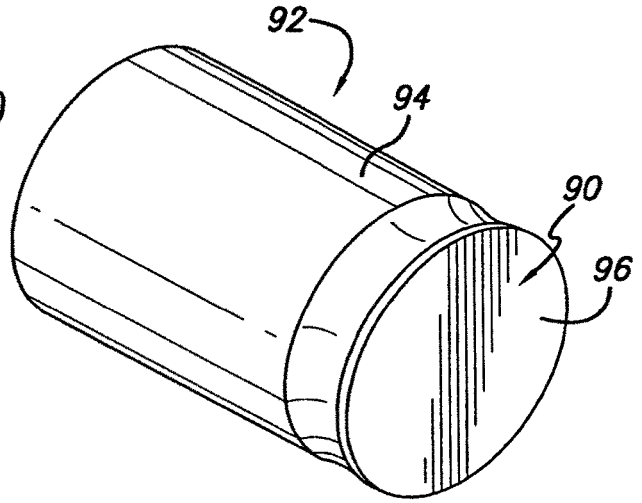
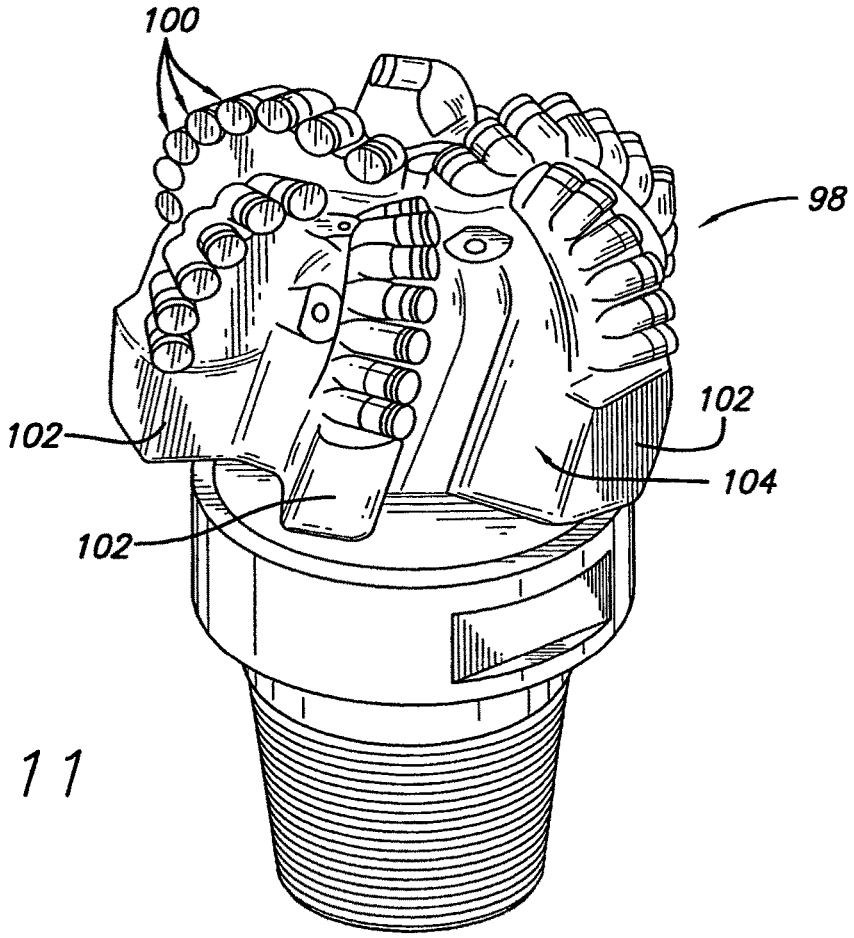
FIG. 11

THERMALLY STABLE DIAMOND POLYCRYSTALLINE DIAMOND CONSTRUCTIONS

FIELD OF THE INVENTION

This invention generally relates to polycrystalline diamond materials and, more specifically, to polycrystalline diamond materials that have been specifically engineered to provide an improved degree of thermal stability when compared to conventional polycrystalline diamond materials, thereby providing an improved degree of service life in desired cutting and/or drilling applications.

BACKGROUND OF THE INVENTION

Polycrystalline diamond (PCD) materials and PCD elements formed therefrom are well known in the art. Conventional PCD is formed by combining synthetic diamond grains with a suitable solvent catalyst material to form a mixture. The mixture is subjected to processing conditions of extremely high pressure/high temperature, where the solvent catalyst material promotes desired intercrystalline diamond-to-diamond bonding between the grains, thereby forming a PCD structure. The resulting PCD structure produces enhanced properties of wear resistance and hardness, making PCD materials extremely useful in aggressive wear and cutting applications where high levels of wear resistance and hardness are desired.

Solvent catalyst materials typically used for forming conventional PCD include metals from Group VIII of the Periodic table, with cobalt (Co) being the most common. Conventional PCD can comprise from 85 to 95% by volume diamond and a remaining amount solvent catalyst material. The material microstructure of conventional PCD comprises regions of intercrystalline bonded diamond with solvent catalyst material attached to the diamond and/or disposed within interstices or interstitial regions that exist between the intercrystalline bonded diamond regions.

A problem known to exist with such conventional PCD materials is that they are vulnerable to thermal degradation, when exposed to elevated temperature cutting and/or wear applications, caused by the differential that exists between the thermal expansion characteristics of the interstitial solvent metal catalyst material and the thermal expansion characteristics of the intercrystalline bonded diamond. Such differential thermal expansion is known to occur at temperatures of about 400° C., can cause ruptures to occur in the diamond-to-diamond bonding, and eventually result in the formation of cracks and chips in the PCD structure, rendering the PCD structure unsuited for further use.

Another form of thermal degradation known to exist with conventional PCD materials is one that is also related to the presence of the solvent metal catalyst in the interstitial regions and the adherence of the solvent metal catalyst to the diamond crystals. Specifically, the solvent metal catalyst is known to cause an undesired catalyzed phase transformation in diamond (converting it to carbon monoxide, carbon dioxide, or graphite) with increasing temperature, thereby limiting practical use of the PCD material to about 750° C.

Attempts at addressing such unwanted forms of thermal degradation in conventional PCD materials are known in the art. Generally, these attempts have focused on the formation of a PCD body having an improved degree of thermal stability when compared to the conventional PCD materials discussed above. One known technique of producing a PCD body having improved thermal stability involves, after forming the PCD body, removing all or a portion of the solvent catalyst material therefrom.

For example, U.S. Pat. No. 6,544,308 discloses a PCD element having improved wear resistance comprising a diamond matrix body that is integrally bonded to a metallic substrate. While the diamond matrix body is formed using a catalyzing material during high temperature/high pressure processing, the diamond matrix body is subsequently treated to render a region extending from a working surface to a depth of at least about 0.1 mm substantially free of the catalyzing material, wherein 0.1 mm is described as being the critical depletion depth.

Japanese Published Patent Application 59-219500 discloses a diamond sintered body joined together with a cemented tungsten carbide base formed by high temperature/high pressure process, wherein the diamond sintered body comprises diamond and a ferrous metal binding phase. Subsequent to the formation of the diamond sintered body, a majority of the ferrous metal binding phase is removed from an area of at least 0.2 mm from a surface layer of the diamond sintered body.

In addition to the above-identified references that disclose treatment of the PCD body to improve the thermal stability by removing the catalyzing material from a region of the diamond body extending a minimum distance from the diamond body surface, there are other known references that disclose the practice of removing the catalyzing material from the entire PCD body. While this approach produces an entire PCD body that is substantially free of the solvent catalyst material, is it fairly time consuming. Additionally, a problem known to exist with this approach is that the lack of solvent metal catalyst within the PCD body precludes the subsequent attachment of a metallic substrate to the PCD body by solvent catalyst infiltration.

Additionally, PCD bodies rendered thermally stable by removing substantially all of the catalyzing material from the entire body have a coefficient of thermal expansion that is sufficiently different from that of conventional substrate materials (such as WC—Co and the like) that are typically infiltrated or otherwise attached to the PCD body. The attachment of such substrates to the PCD body is highly desired to provide a PCD compact that can be readily adapted for use in many desirable applications. However, the difference in thermal expansion between the thermally stable PCD body and the substrate, and the poor wetability of the thermally stable PCD body diamond surface due to the substantial absence of solvent metal catalyst, makes it very difficult to bond the thermally stable PCD body to conventionally used substrates. Accordingly, such PCD bodies must be attached or mounted directly to a device for use, i.e., without the presence of an adjoining substrate.

Since such PCD bodies, rendered thermally stable by having the catalyzing material removed from the entire diamond body, are devoid of a metallic substrate they cannot (e.g., when configured for use as a drill bit cutter) be attached to a drill bit by conventional brazing process. The use of such thermally stable PCD body in this particular application necessitates that the PCD body itself be mounted to the drill bit by mechanical or interference fit during manufacturing of the drill bit, which is labor intensive, time consuming, and does not provide a most secure method of attachment.

While these above-noted known approaches provide insight into diamond bonded constructions capable of providing some improved degree of thermal stability when compared to conventional PCD constructions, it is believed that further improvements in thermal stability for PCD materials useful for desired cutting and wear applications can be obtained according to different approaches that are both capable of minimizing the amount of time and effort necessary to achieve the same, and that permit formation of a thermally stable PCD construction comprising a desired substrate bonded thereto to facilitate attachment of the construction with a desired application device.

It is, therefore, desired that diamond compact constructions be developed that include a PCD body having an improved degree of thermal stability when compared to conventional PCD materials, and that include a substrate material bonded to the PCD body to facilitate attachment of the resulting thermally stable compact construction to an application device by conventional method such as welding or brazing and the like. It is further desired that such a compact construction provide a desired degree of thermal stability in a manner that can be manufactured at reasonable cost without requiring excessive manufacturing times and without the use of exotic materials or techniques.

SUMMARY OF THE INVENTION

Thermally stable diamond constructions, prepared according to principles of this invention, comprise a diamond body having a plurality of bonded diamond crystals and a plurality of interstitial regions disposed among the crystals. A metallic substrate is attached to the diamond body. The diamond body includes a working surface positioned along an outside portion of the body and a side surface extending away from the working surface. The diamond body comprises a first region adjacent at least a portion of the side surface that is substantially free of a catalyst material and that extends a partial depth into the diamond body. The diamond body further includes a second region that includes the catalyst material.

In an example embodiment, the first region extends along about 25 to 100 percent of a length the side surface. The first region extends from the side surface a depth within the diamond body of between about 0.02 micrometers to 1 mm. The depth along this side surface can vary as a function of distance moving away from the working surface.

In an example embodiment, the thermally stable diamond construction first region further extends to at least a portion of the working surface and a partial depth into the diamond body from the at least a portion of working surface. The first region extending a partial depth from the working surface may extend to between about 0.02 to 0.09 mm.

In an example embodiment, the diamond body comprises diamond crystals having an average diamond grain size of greater than about 0.02 mm, and comprises at least 85 percent by volume diamond based on the total volume of the diamond body. Additionally, the second region can have an average thickness of at least about 0.01 mm. The diamond body, or one or more region therein, can be formed from natural diamond grains and/or a mixture or blend of natural diamond grains and synthetic diamond grains.

Thermally stable diamond constructions of this invention may be provided in the form of a compact comprising a PCD body attached to a substrate. The compact is treated to provide the desired first region, while allowing the catalyst material to remain untreated in a second region of the diamond body. In an example embodiment, before the compact is treated, the surface portion of the compact to be treated is finished to an approximate final dimension.

Thermally stable constructions of this invention display an enhanced degree of thermal stability when compared to conventional PCD materials, and include a substrate material bonded to the PCD body that facilitates attachment therewith to an application device by conventional method such as welding or brazing and the like.

BRIEF DESCRIPTION OF THE DRAWINGS

These and other features and advantages of the present invention will be appreciated as the same becomes better understood by reference to the following detailed description when considered in connection with the accompanying drawings wherein:

FIG. 10 is a schematic perspective side view of a diamond shear cutter comprising the thermally stable polycrystalline diamond construction of this invention;

FIG. 11 is a perspective side view of a drag bit comprising a number of the shear cutters of FIG. 10.

DETAILED DESCRIPTION

Thermally stable polycrystalline diamond (TSPCD) constructions of this invention are specifically engineered having a diamond bonded body comprising a region of thermally stable diamond extending a selected depth from a body working or cutting surface, thereby providing an improved degree of thermal stability when compared to conventional PCD materials not having such a thermally stable diamond region.

As used herein, the term "PCD" is used to refer to polycrystalline diamond that has been formed, at high pressure/high temperature (HPHT) conditions, through the use of a solvent metal catalyst, such as those included in Group VIII of the Periodic table. "Thermally stable polycrystalline diamond" as used herein is understood to refer to intercrystalline bonded diamond that includes a volume or region that is or that has been rendered substantially free of the solvent metal catalyst used to form PCD, or the solvent metal catalyst used to form PCD remains in the region of the diamond body but is otherwise reacted or otherwise rendered ineffective in its ability adversely impact the bonded diamond at elevated temperatures as discussed above.

TSPCD constructions of this invention can further include a substrate attached to the diamond body that facilitates the attachment of the TSPCD construction to cutting or wear devices, e.g., drill bits when the TSPCD construction is configured as a cutter, by conventional means such as by brazing and the like.

Figure 1:
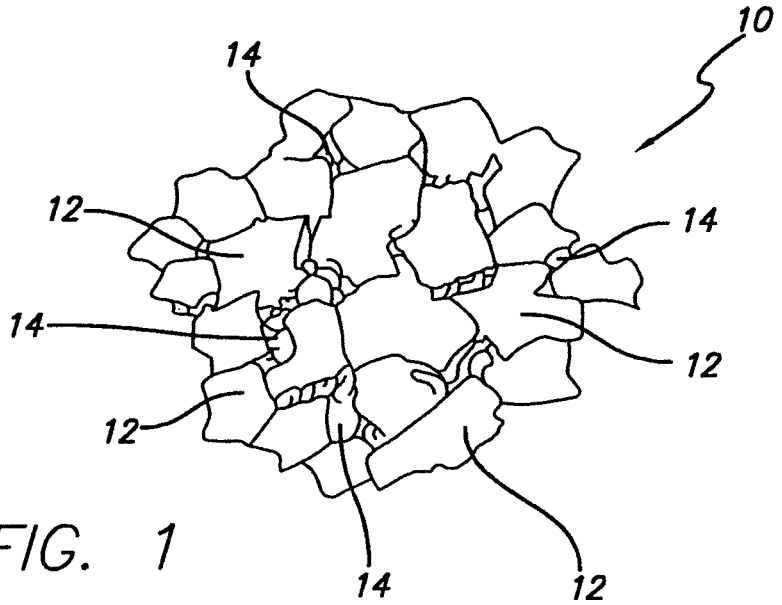
FIG. 1 is a schematic view of a region of polycrystalline diamond prepared in accordance with principals of this invention.

FIG. 1 illustrates a region of PCD 10 formed during a high pressure/high temperature (HPHT) process stage of forming this invention. The PCD has a material microstructure comprising a material phase of intercrystalline diamond made up of a plurality of bonded together adjacent diamond grains 12 at HPHT conditions. The PCD material microstructure also includes interstitial regions 14 disposed between bonded together adjacent diamond grains. During the HPHT process, the solvent metal catalyst used to facilitate the bonding together of the diamond grains migrates into and resides within these interstitial regions 14.

Figure 2A:
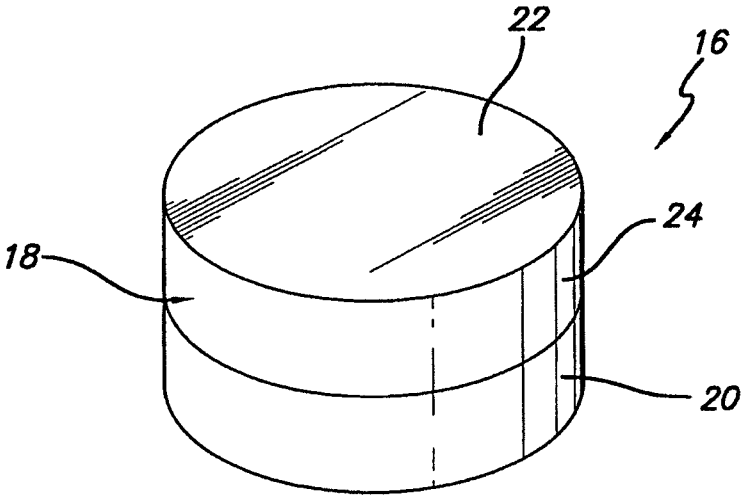
FIGS. 2A to 2E are perspective views of different polycrystalline diamond compacts of this invention comprising the region illustrated in FIG. 1.

FIG. 2A illustrates an example PCD compact 16 formed in accordance with this invention by HPHT process. The PCD compact 16 generally comprises a PCD body 18, having the material microstructure described above and illustrated in FIG. 1, that is bonded to a desired substrate 20. Although the PCD compact 16 is illustrated as being generally cylindrical in shape and having a disk-shaped flat or planar surface 22, it is understood that this is but one preferred embodiment and that the PCD body as used with this invention can be configured other than as specifically disclosed or illustrated. It is further to be understood that the compact 16 may be configured having working or cutting surfaces disposed along the disk-shaped surface and/or along side surfaces 24 of the PCD body, depending on the particular cutting or wear application. Alternatively, the PCD compact may be configured having an altogether different shape but generally comprising a substrate and a PCD body bonded to the substrate, wherein the PCD body is provided with working or cutting surfaces oriented as necessary to perform working or cutting service when the compact is mounted to a desired drilling or cutting device, e.g., a drill bit.

Figure 2B:
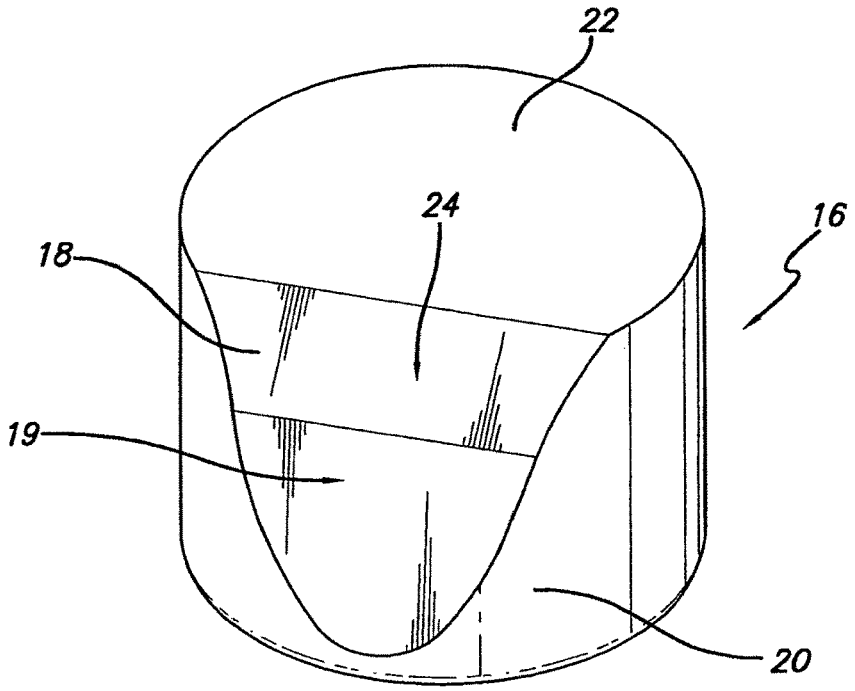
Figure 2C:
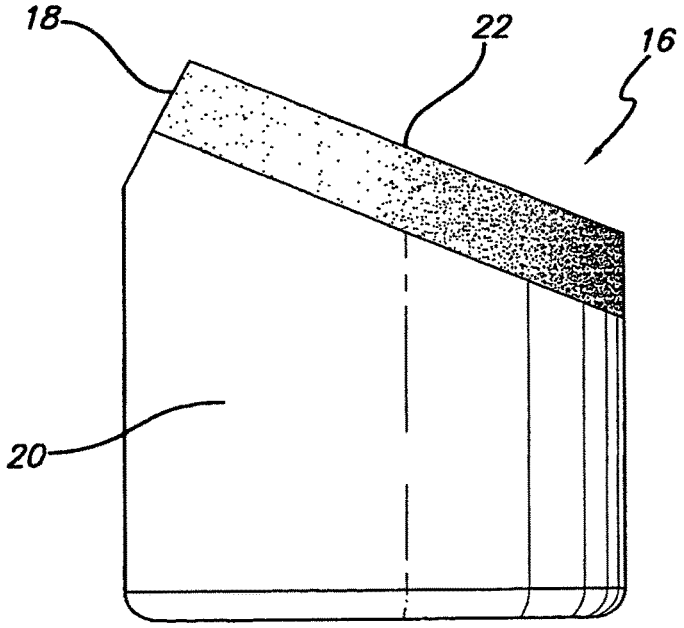
Figure 2D:
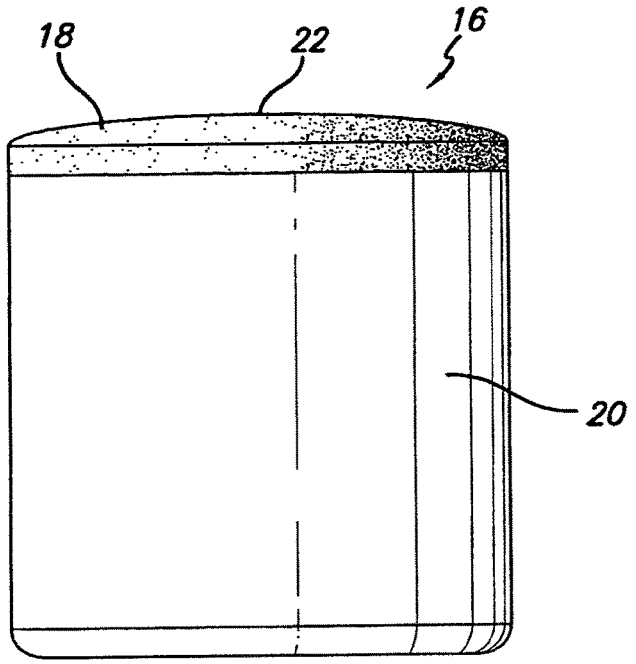

FIGS. 2B to 2D illustrate alternative embodiments of PCD compacts of this invention having a substrate and/or PCD body configured differently than that illustrated in FIG. 2A. For example, FIG. 2B illustrates a PCD compact 16 configured in the shape of a preflat or gage trimmer including a cut-off portion 19 of the PCD body 18 and the substrate 20. The preflat includes working or cutting surface positioned along a disk-shaped surface 22 and a side surface 24 working surface. Alternative preflat or gage trimmer PCD compact configurations intended to be within the scope of this invention include those described in U.S. Pat. No. 6,604,588, which is incorporated herein by reference.

FIG. 2C illustrates another embodiment of a PCD compact 16 of this invention configured having the PCD body 18 disposed onto an angled underlying surface of the substrate 20 and having a disk-shaped surface 22 that is the working surface and that is positioned at an angle relative to an axis of the compact. FIG. 2D illustrates another embodiment of a PCD compact 16 of this invention configured having the substrate 20 and the PCD body 18 disposed onto a surface of the substrate. In this particular embodiment, the PCD body has a domed or convex surface 22 serving as the working surface 22 (similar to the PCD compact embodiment described below and illustrated in FIG. 7).

Figure 2E:
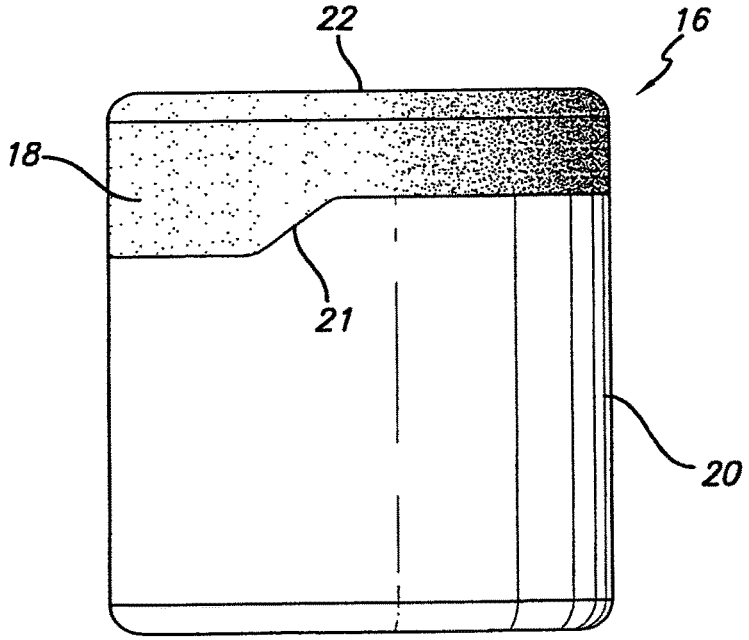

FIG. 2E illustrates a still other embodiment of a PCD compact 16 of this invention that is somewhat similar to that illustrated in FIG. 2A in that it includes a PCD body 18 disposed on the substrate 20 and having a disk-shaped surface 22 as a working surface. Unlike the embodiment of FIG. 2A, however, this PCD compact includes an interface 21 between the PCD body and the substrate that is not uniformly planar. In this particular example, the interface 21 is canted or otherwise non-axially symmetric. It is to be understood that PCD compacts of this invention can be configured having PCD body-substrate interfaces that are uniformly planer or that are not uniformly planer in a manner that is symmetric or nonsymmetric relative to an axis running through the compact. Examples of other configurations of PCD compacts having nonplanar PCD body-substrate interfaces include those described in U.S. Pat. No. 6,550,556, which is incorporated herein by reference.

Diamond grains useful for forming the PCD body of this invention during the HPHT process include diamond powders having an average diameter grain size in the range of from submicrometer in size to 0.1 mm, and more preferably in the range of from about 0.005 mm to 0.08 mm. The diamond powder can contain grains having a mono or multi-modal size distribution. In a preferred embodiment for a particular application, the diamond powder has an average particle grain size of approximately 20 to 25 micrometers. However, it is to be understood that the use of diamond grains having a grain size less than this amount, e.g., less than about 15 micrometers, is useful for certain drilling and/or cutting applications. In the event that diamond powders are used having differently sized grains, the diamond grains are mixed together by conventional process, such as by ball or attrittor milling for as much time as necessary to ensure good uniform distribution.

The diamond powder used to prepare the PCD body can be synthetic diamond powder. Synthetic diamond powder is known to include small amounts of solvent metal catalyst material and other materials entrained within the diamond crystals themselves. Alternatively, the diamond powder used to prepare the PCD body can be natural diamond powder. Unlike synthetic diamond grains, natural diamond grains do not include solvent metal catalyst material and/or other noncatalyst materials entrained within the diamond crystals. The inclusion of catalyst material as well as other noncatalyst material in the crystals of the synthetic diamond powder can operate to impair or limit the extent to which the resulting PCD body is or can be rendered thermally stable. Since natural diamond grains are largely devoid of these other materials which cannot be removed from the synthetic diamond grains, a higher degree of thermal stability exists or can thus be obtained.

Accordingly, for applications calling for a high degree of thermal stability, the use of natural diamond for forming the PCD body is preferred. Additionally, PCD bodies of this invention can be formed by selectively use of natural diamond grains to form the entire PCD body or one or more regions of the body where a desired improved degree of thermal stability is desired. In such embodiment, the PCD body can be formed using natural diamond to form a first region where a desired improved degree of thermal stability is desired, e.g., a region defining a working or side surface of the body, and another region of the body can be formed from synthetic diamond grains. This other region can, for example, a region that does not form a working surface but perhaps forms an interface with a substrate, where such an improved degree of thermal stability is not needed.

Alternatively, PCD bodies of this invention can be formed using a mixture of natural diamond and synthetic diamond throughout the entire diamond body, or only at one or more selected regions of the PCD body. For example, natural diamond and synthetic diamond grains can be combined at a desired mix ratio to provide a tailored improvement in the degree of thermal stability for the particular PCD body region or regions best suited for a particular PCD body application. While PCD bodies of this invention include a region rendered thermally stable by treating to render the region substantially free of a catalyst material, it is to be understood that PCD bodies of this invention may also include a region wherein the thermally stability is improved without requiring such treatment by forming such region to have a higher diamond density using natural diamond grains.

The diamond grain powder, whether synthetic or natural, is combined with or already includes a desired amount of catalyst material to facilitate desired intercrystalline diamond bonding during HPHT processing. Suitable catalyst materials useful for forming the PCD body include those solvent metals selected from the Group VIII of the Periodic table, with cobalt (Co) being the most common, and mixtures or alloys of two or more of these materials. The diamond grain powder and catalyst material mixture can comprise 85 to 95% by volume diamond grain powder and the remaining amount catalyst material. Alternatively, the diamond grain powder can be used without adding a solvent metal catalyst in applications where the solvent metal catalyst can be provided by infiltration during HPHT processing from the adjacent substrate or adjacent other body to be bonded to the PCD body.

In certain applications it may be desired to have a PCD body comprising a single PCD-containing volume or region, while in other applications it may be desired that a PCD body be constructed having two or more different PCD-containing volumes or regions. For example, it may be desired that the PCD body include a first PCD-containing region extending a distance from a working surface, and a second PCD-containing region extending from the first PCD-containing region to the substrate. The PCD-containing regions can be formed having different diamond densities and/or be formed from different diamond grain sizes. It is, therefore, understood that TSPCD constructions of this invention may include one or multiple PCD regions within the PCD body as called for by a particular drilling or cutting application.

The diamond grain powder and catalyst material mixture is preferably cleaned, and loaded into a desired container for placement within a suitable HPHT consolidation and sintering device, and the device is then activated to subject the container to a desired HPHT condition to consolidate and sinter the diamond powder mixture to form PCD.

In an example embodiment, the device is controlled so that the container is subjected to a HPHT process comprising a pressure in the range of from 5 to 7 GPa and a temperature in the range of from about 1320 to 1600° C., for a sufficient period of time. During this HPHT process, the catalyst material in the mixture melts and infiltrates the diamond grain powder to facilitate intercrystalline diamond bonding. During the formation of such intercrystalline diamond bonding, the catalyst material migrates into the interstitial regions within the microstructure of the so-formed PCD body that exists between the diamond bonded grains (see FIG. 1).

The PCD body can be formed with or without having a substrate material bonded thereto. In the event that the formation of a PCD compact comprising a substrate bonded to the PCD body is desired, a selected substrate is loaded into the container adjacent the diamond powder mixture prior to HPHT processing. An advantage of forming a PCD compact having a substrate bonded thereto is that it enables attachment of the to-be-formed TSPCD construction to a desired wear or cutting device by conventional method, e.g., brazing or welding. Additionally, in the event that the PCD body is to be bonded to a substrate, and the substrate includes a metal solvent catalyst, the metal solvent catalyst needed for catalyzing intercrystalline bonding of the diamond can be provided by infiltration. In which case is may not be necessary to mix the diamond powder with a metal solvent catalyst prior to HPHT processing.

Suitable materials useful as substrates for forming PCD compacts of this invention include those conventionally used as substrates for conventional PCD compacts, such as those formed from metallic and cermet materials. In a preferred embodiment, the substrate is provided in a preformed state and includes a metal solvent catalyst that is capable of infiltrating into the adjacent diamond powder mixture during processing to facilitate and provide a bonded attachment therewith. Suitable metal solvent catalyst materials include those selected from Group VIII elements of the Periodic table. A particularly preferred metal solvent catalyst is cobalt (Co). In a preferred embodiment, the substrate material comprises cemented tungsten carbide (WC—Co).

Once formed, the PCD body or compact is treated to render a selected region thereof thermally stable. This can be done, for example, by removing substantially all of the catalyst material from the selected region by suitable process, e.g., by acid leaching, aqua regia bath, electrolytic process, or combinations thereof. Alternatively, rather than actually removing the catalyst material from the PCD body or compact, the selected region of the PCD body or compact can be rendered thermally stable by treating the catalyst material in a manner that reduces or eliminates the potential for the catalyst material to adversely impact the intercrystalline bonded diamond at elevated temperatures. For example, the catalyst material can be combined chemically with another material to cause it to no longer act as a catalyst material, or can be transformed into another material that again causes it to no longer act as a catalyst material. Accordingly, as used herein, the terms "removing substantially all" or "substantially free" as used in reference to the catalyst material is intended to cover the different methods in which the catalyst material can be treated to no longer adversely impact the intercrystalline diamond in the PCD body or compact with increasing temperature. Additionally, as noted above, the PCD body may alternatively be formed from natural diamond grains and to have a higher diamond density, to thereby reduce the level of catalyst material in the body. In some applications, this may be considered to render it sufficiently thermally stable without the need for further treatment.

It is desired that the selected thermally stable region for TSPCD constructions of this invention is one that extends a determined depth from at least a portion of the surface, e.g., at least a portion of the working or cutting surface, of the diamond body independent of the working or cutting surface orientation. Again, it is to be understood that the working or cutting surface may include more than one surface portion of the diamond body. In an example embodiment, it is desired that the thermally stable region extend from a working or cutting surface of the PCD body an average depth of at least about 0.008 mm to an average depth of less than about 0.1 mm, preferably extend from a working or cutting surface an average depth of from about 0.02 mm to an average depth of less than about 0.09 mm, and more preferably extend from a working or cutting surface an average depth of from about 0.04 min to an average depth of about 0.08 mm. The exact depth of the thermally stable region can and will vary within these ranges for TSPCD constructions of this invention depending on the particular cutting and wear application.

Generally, it has been shown that thermally stable regions within these ranges of depth from the working surface produce a TSPCD construction having improved properties of wear and abrasion resistance when compared to conventional PCD compacts, while also providing desired properties of fracture strength and toughness. It is believed that thermally stable regions having depths beneath the working surface greater than the upper limits noted above, while possibly capable of exhibiting a higher degree of wear and abrasion resistance, would in fact be brittle and have reduced strength and toughness, for aggressive drilling and/or cutting applications, and for this reason would likely fail in application and exhibit a reduced service life due to premature spalling or chipping.

It is to be understood that the depth of the thermally stable region from at least a portion of the working or cutting surface is represented as being a nominal, average value arrived at by taking a number of measurements at preselected intervals along this region and then determining the average value for all of the points. The region remaining within the PCD body or compact beyond this thermally stable region is understood to still contain the catalyst material.

Additionally, when the PCD body to be treated includes a substrate, i.e., is provided in the form of a PCD compact, it is desired that the selected depth of the region to be rendered thermally stable be one that allows a sufficient depth of region remaining in the PCD compact that is untreated to not adversely impact the attachment or bond formed between the diamond body and the substrate, e.g., by solvent metal infiltration during the HPHT process. In an example PCD compact embodiment, it is desired that the untreated or remaining region within the diamond body have a thickness of at least about 0.01 mm as measured from the substrate. It is, however, understood that the exact thickness of the PCD region containing the catalyst material next to the substrate can and will vary depending on such factors as the size and configuration of the compact, i.e., the smaller the compact diameter the smaller the thickness, and the particular PCD compact application.

In an example embodiment, the selected region of the PCD body is rendered thermally stable by removing substantially all of the catalyst material therefrom by exposing the desired surface or surfaces to acid leaching, as disclosed for example in U.S. Pat. No. 4,224,380, which is incorporated herein by reference. Generally, after the PCD body or compact is made by HPHT process, the identified surface or surfaces, e.g., at least a portion of the working or cutting surfaces, are placed into contact with the acid leaching agent for a sufficient period of time to produce the desired leaching or catalyst material depletion depth.

Suitable leaching agents for treating the selected region to be rendered thermally stable include materials selected from the group consisting of inorganic acids, organic acids, mixtures and derivatives thereof. The particular leaching agent that is selected can depend on such factors as the type of catalyst material used, and the type of other non-diamond metallic materials that may be present in the PCD body, e.g., when the PCD body is formed using synthetic diamond powder. While removal of the catalyst material from the selected region operates to improve the thermal stability of the selected region, it is known that PCD bodies especially formed from synthetic diamond powder can include, in addition to the catalyst material, noncatalyst materials, such as other metallic elements that can also contribute to thermal instability.

For example, one of the primary metallic phases known to exist in the PCD body formed from synthetic diamond powder is tungsten. It is, therefore, desired that the leaching agent selected to treat the selected PCD body region be one capable of removing both the catalyst material and such other known metallic materials. In an example embodiment, suitable leaching agents include hydrofluoric acid (HF), hydrochloric acid (HCl), nitric acid ($HNO_3$), and mixtures thereof.

In an example embodiment, where the diamond body to be treated is in the form of a PCD compact, the compact is prepared for treatment by protecting the substrate surface and other portions of the PCD body adjacent the desired treated region from contact (liquid or vapor) with the leaching agent. Methods of protecting the substrate surface include covering, coating or encapsulating the substrate and portion of PCD body with a suitable barrier member or material such as wax, plastic or the like.

Figure 12:
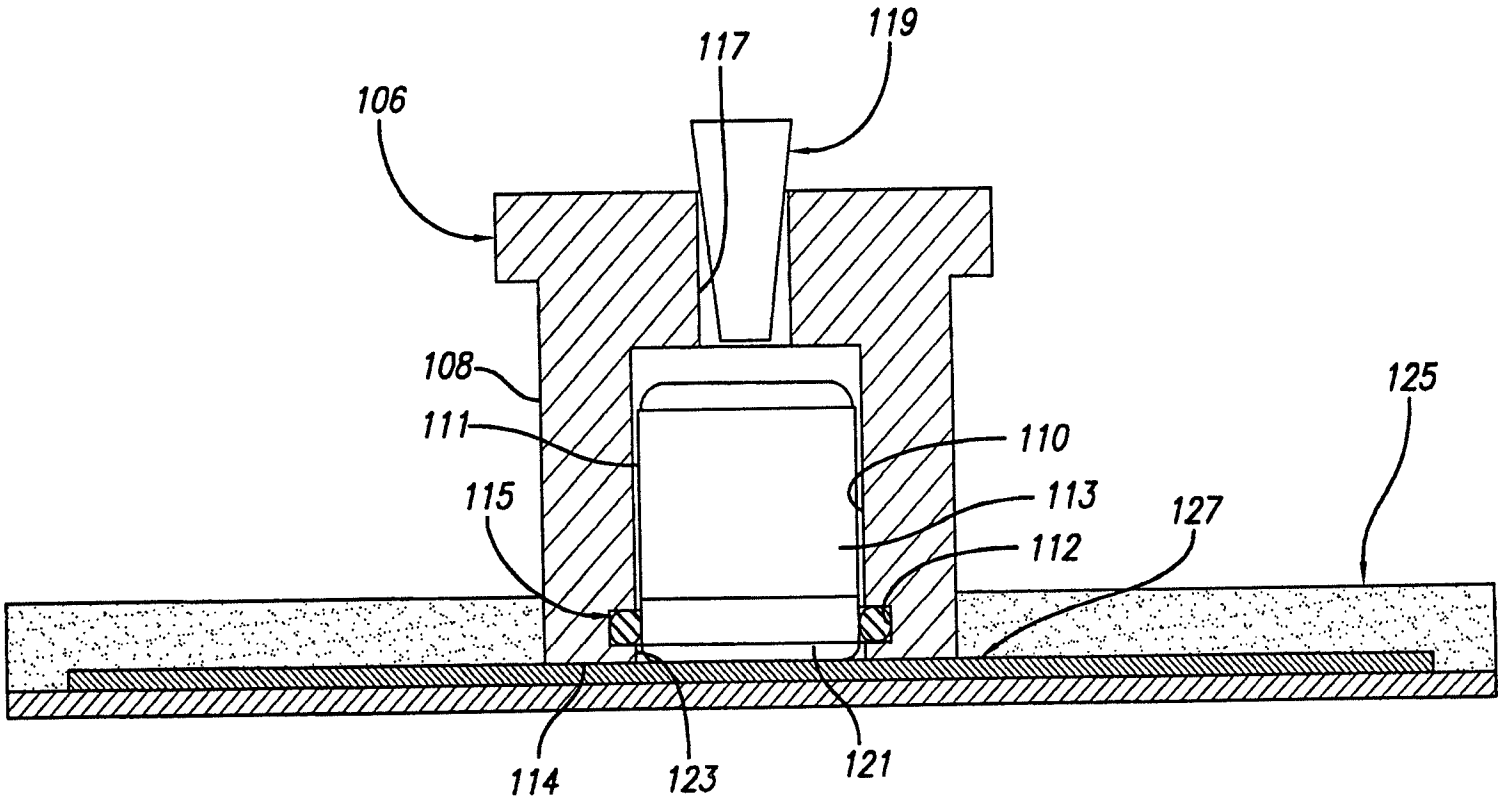
FIG. 12 is a cross-sectional perspective view of a protective fixture.

Referring to FIG. 12, in a preferred embodiment, the compact substrate surface and portion of the diamond body is protected by using an acid-resistant fixture 106 that is specially designed to encapsulate the desired surfaces of the substrate and diamond body. Specifically, the fixture 106 is configured having a cylindrical body 108 within an inside surface diameter 110 that is sized to fit concentrically around the outside surface 111 of the compact 113. The fixture inside surface 110 can include a groove 112 extending circumferentially therearound and that is positioned adjacent to an end 114 of the fixture. The groove is sized to accommodate placement of a seal 115, e.g., in the form of an elastomeric O-ring or the like, therein. Alternatively, the fixture can be configured without a groove and a suitable seal can simply be interposed between the opposed respective compact and fixture outside and inside diameter surfaces. When placed around the outside surface of the compact, the seal operates to provide a leak-tight seal between the compact and the fixture to prevent unwanted migration of the leaching agent therebetween.

In a preferred embodiment, the fixture 106 includes an opening 117 in its end that is axially opposed to end 114. The opening operates both to prevent an unwanted build up of pressure within the fixture when the PCD compact is loaded therein (which pressure could operate to urge the compact away from its loaded position within the fixture), and to facilitate the removal of the compact from the fixture once the treatment process is completed (e.g., the opening provides an access port for pushing the compact out of the fixture by mechanical or pressure means). During the process of treating the compact, the opening 117 is closed using a suitable seal element 119, e.g., in the form of a removable plug or the like.

In preparation for treatment, the fixture is positioned axially over the PCD compact and the compact is loaded into the fixture with the compact working surface directly outwardly towards the fixture end 114. The compact is then positioned within the fixture so that the compact working surface 121 projects a desired distance outwardly from sealed engagement with the fixture inside wall. Positioned in this manner within the fixture, the compact working surface 121 is freely exposed to make contact with the leaching agent via fixture opening 123 positioned at end 114.

The PCD compact 113 and fixture 106 form an assembly that are then placed into a suitable container that includes a desired volume of the leaching agent 125. In a preferred embodiment, the level of the leaching agent within the container is such that the diamond body working surface 121 exposed within the fixture is completely immersed into the leaching agent. In a preferred embodiment, a sheet of perforated material 127, e.g., in the form of a mesh material that is chemically resistant to the leaching agent, can be placed within the container and interposed between the assembly and the container surface to provide a desired distance between the fixture and the container. The use of a perforated material ensures that, although it is in contact with the assembly, the leaching agent will be permitted to flow to the exposed compact working surface to produce the desired leaching result.

Figure 3:
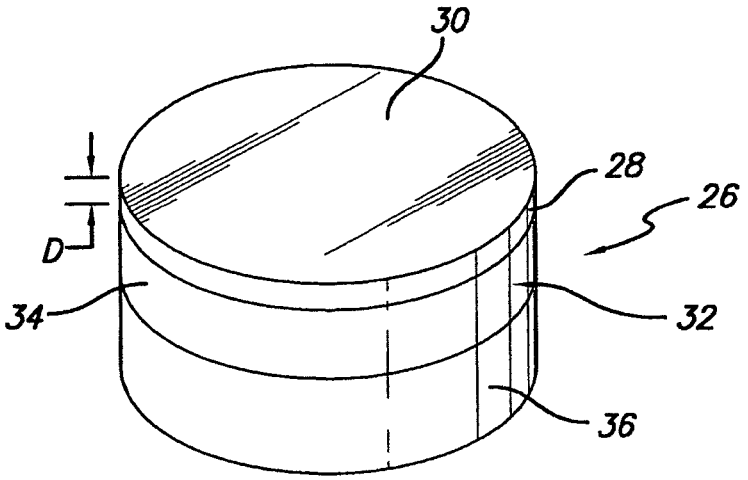
FIG. 3 is a perspective view of an example embodiment thermally stable polycrystalline diamond construction of this invention.
Figure 4:
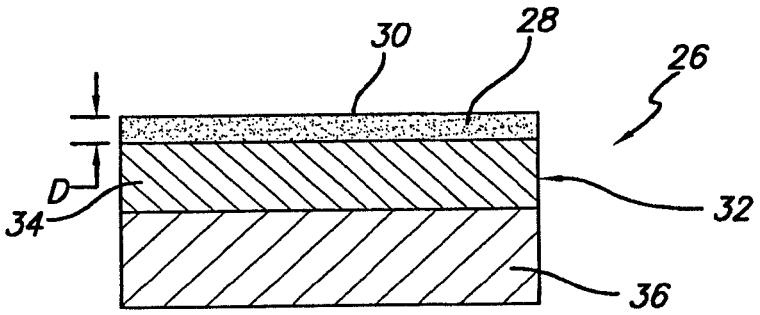
FIG. 4 is a cross-sectional side view of the example embodiment thermally stable polycrystalline diamond construction of this invention as illustrated in FIG. 3.

FIGS. 3 and 4 illustrate an embodiment of the TSPCD construction 26 of this invention after its has been treated to render a selected region of the PCD body thermally stable. The construction comprises a thermally stable region 28 that extends a selected depth "D" from a working or cutting surface 30 of the diamond body 32. The remaining region 34 of the diamond body 32 extending from the thermally stable region 28 to the substrate 36 comprises PCD having the catalyst material intact. In a first example embodiment, the thermally stable region extends a depth of approximately 0.045 mm from the working or cutting surface. In a second example embodiment, the thermally stable region extends a depth of approximately 0.075 mm from the working or cutting surface. Again, it is to be understood that the exact depth of the thermally stable region can and will vary within the ranges noted above depending on the particular end use drilling and or cutting applications.

Additionally, as mentioned briefly above, it is to be understood that the TSPCD construction described above and illustrated in FIGS. 3 and 4 are representative of a single embodiment of this invention for purposes of reference, and that TSPCD constructions other than that specifically described and illustrated are within the scope of this invention. For example, TSPCD constructions comprising a diamond body having a thermally stable region and then two or more other regions are possible, wherein a region interposed between the thermally stable region and the region adjacent the substrate may be a transition region having a diamond density and/or formed from diamond grains sized differently from that of the other diamond-containing regions.

Figure 5:
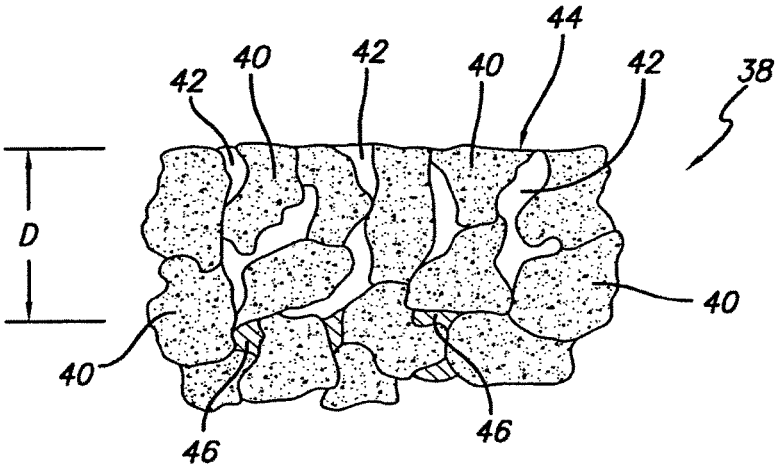
FIG. 5 is a schematic view of a region of the thermally stable polycrystalline diamond construction of this invention.

FIG. 5 illustrates the material microstructure 38 of the TSPCD construction of this invention and, more specifically, a section of the thermally stable region of the TSPCD construction. The thermally stable region comprises the intercrystalline bonded diamond made up of the plurality of bonded together diamond grains 40, and a matrix of interstitial regions 42 between the diamond grains that are now substantially free of the catalyst material. The thermally stable region comprising the interstitial regions free of the catalyst material is shown to extend a distance "D" from a working or cutting surface 44 of the TSPCD construction. In an example embodiment, the distance "D" is identified and measured by cross sectioning a TSPCD construction and using a sufficient level of magnification to identify the interface between the first and second regions. As illustrated in FIG. 5, the interface is generally identified as the location within the diamond body where a sufficient population of the catalyst material 46 is shown to reside within the interstitial regions.

The so-formed thermally stable region of TSPCD constructions of this invention is not subject to the thermal degradation encountered in the remaining areas of the PCD diamond body, resulting in improved thermal characteristics. The remaining region of the diamond body extending from depth "D" has a material microstructure that comprises PCD, as described above and illustrated in FIG. 1, that includes catalyst material 46 disposed within the interstitial regions.

Figure 6:
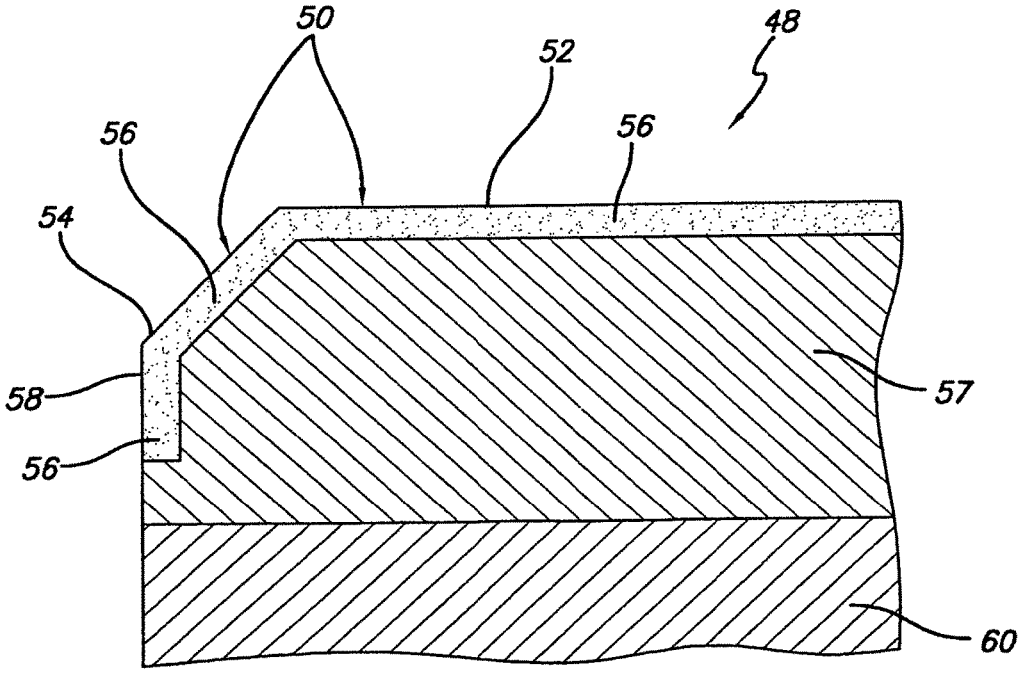
FIG. 6 is a cross-sectional side view of a region of an example embodiment thermally stable polycrystalline diamond construction of this invention.

In an example embodiment, the working surface extends along the upper surface of the construction embodiment illustrated in FIG. 2. FIG. 6 illustrates an example embodiment TSPCD construction 48 of this invention comprising a working surface 50 that includes a substantially planar upper surface 52 of the construction and may be considered to also include a beveled surface 54 that defines a circumferential edge of the upper surface. In this embodiment, the thermally stable region 56 extends the selected depth into the diamond body 57 from both the upper and beveled surfaces 52 and 54. Accordingly, in this example embodiment, the upper and beveled surfaces 52 and 54 are understood to be the working surfaces of the construction. Alternatively, TSPCD constructions of this invention may include a working surface a first beveled or radiused surface, a second beveled or radiused surface, or other surface feature interposed between the upper surface and a side surface, as well as the side surface. In such case, the first beveled surface may be considered part of the working surface and any subsequent surface, especially if at an angle greater than 65° with respect to a plane at the top surface, considered part of the side surface. In general, the side surface is understood to be any surface substantially perpendicular to the upper surface of the constriction.

In such embodiment, prior to treating the PCD compact to render the selected region thermally stable, the PCD compact is formed to have such working surface, i.e., is formed by machine process or the like to provide the desired the beveled surface 54 or other surface feature as discussed above. In an example embodiment, the PCD compact is finished into its approximate final dimension prior to treating, e.g., is machine finished prior to leaching. Thus, a feature of TSPCD constructions of this invention is that they include working or cutting surfaces, independent of location or orientation, having a thermally stable region extending a predetermined depth into the diamond body that is not substantially altered subsequent to treating and prior to use.

For certain applications, it has been discovered than an improved degree of thermal stability can be realized by providing a thermally stable region along the side surface of the construction As illustrated in FIG. 6, the thermally stable region 56 extends along a side surface 58 of the construction and includes the beveled surface 54. As noted above, the side surface 58 of the construction is oriented substantially perpendicular to the upper surface 52, and extends from the bevel surface to the substrate 60.

Extending the thermally stable region to along the side surface 58 of the construction operates to improve the life of the construction when placed into operation, e.g., when used as a cutter in a drill bit placed into a subterranean drilling application. This is believed to occur because the enhanced thermal conductivity provided by the thermally stable side surface portion operates to help conduct heat away working surface of the construction, thereby increasing the thermal gradient of the TSPCD construction, its thermal resistance and service life.

In an example embodiment, where the TSPCD construction is provided in the form of a cutting element for use in a drill bit and the cutting element includes a working surface comprising an upper surface and/or a beveled or other intermediate surface feature extending between the upper surface and the side surface, the thermally stable region may extend axially from the working surface along the side surface of the construction for a distance or length that will vary depending on such factors as the particular material make up of the TSPCD construction, its configuration, and its application. Generally, it is desired that the thermally stable region extend a length that is sufficient to provide a desired improvement in the construction thermal stability and service life.

In an example embodiment, the thermally stable region of the TSPCD construction can extend along the side surface 58 for a length of about 25 to 100 percent of the total length of the side surface as measured from the working surface. The total length of the side surface is that which extends between the working surface and an opposite end of the PCD body or, between the working surface and interface of the substrate 60. In an example embodiment, the thermally stable region can extend along the side surface of the construction for a length that is at least about 40 percent of the total length, or preferably that is at least about 50 percent of the total length.

The thermally stable region extending along the side surface can be formed in the manner described above by selectively covering only that portion of the side surface that is not to be treated along with the substrate. In an example embodiment, where a fixture as described above is used, the fixture can be positioned over a portion of the construction to cover the substrate and any portion of the side surface not to be treated so that both remain protected from the leaching agent. In the event that it is desired that the thermally stable region extend along the entire length of the side surface, then appropriate steps are taken using the fixture or other means to protect only the surface of the substrate from being exposed to the leaching agent. In an example embodiment, the thermally stable region extending along such side surface is formed after the construction has been finished to an approximate final dimension as noted above.

The depth of the thermally stable region extending along the side surface can vary depending on a number of factors, such as the material make up, size, configuration and application of the construction. In an example embodiment, the thermally stable region extends from the side surface a depth within the diamond body of between about 0.02 micrometers to 1 mm. In some cases it may be preferably between about 0.1 mm to 0.5 mm, and more preferably between about 0.15 to 0.3 mm. It is generally desired that the depth of the thermally stable region be sufficient to provide a desired degree thermal stability, hardness and/or toughness to provide the desired improvement in service life. The same treatment techniques discussed above for providing the thermally stable region depth beneath the working surface can be used to provide the desired thermally stable region depth extending from the side surface.

Additionally, in some embodiments, the depth of the thermally stable region extending along the length of the side surface may not be constant. For example, the thermally stable region can be configured to change as a function of distance from the working or cutting surface. In an example embodiment, the depth can decrease or increase as a function of distance from the working surface, thereby providing a tapered depth profile. This profile can be a gradient or can be stepped. In an example embodiment, the TSPCD construction has a thermally stable region extending along the side surface having a tapered depth profile that decreases as a function of distance from the working surface.

The change in depth in such embodiments can be achieved by varying the treatment or process parameters, for example by varying the leaching time used along the side surface. This can be achieved by immersing the construction over a period of time into the leaching agent, thereby subjecting the first immersed portion of the side surface to a longer leaching time than a later immersed portion. Alternatively, the change in depth can be achieved by controlling certain features of the construction itself, e.g., by the selective use of differently sized diamond grains to form different regions along the side surface or throughout the diamond body, which grain side different may influence leaching efficiency. This may also result using PDC construction having a diamond density that varies along the length of the side surface.

While the feature of forming a thermally stable region extending along a side surface portion of TSPCD construction has been described above and illustrated in FIG. 6, it is to be understood according to the practice of this invention that such extended thermally stable regions can be used in conjunction with working or cutting surfaces of any configuration, orientation or placement on the TSPCD construction.

Additionally, while the feature of an extended thermally stable region extending along a side surface of TSPCD constructions of this invention has been disclosed in conjunction with a TSPCD construction having a thermally stable region extending a depth from a working or cutting surface, other embodiments in accordance with the invention may include TSPCD constructions configured to have a thermally stable region extending along a side surface of the construction without a thermally stable region extending a depth along the working or top surface. Such TSPCD constructions, having a thermally stable region extending into the diamond body along a length of the side surface and not extending a depth beneath the working or cutting surface, can be formed by using the same general techniques described above, except that extra measures are used to protect the working or cutting surface from being exposed to during treatment to form the thermally stable region. This can be done by using the same types of barrier materials disclosed above, or by using a special fixture designed to be placed over the working or cutting surface, to protect the working or cutting surfaces from exposure during treatment. Alternatively, a technique may be used wherein the working or cutting surface is protected by simply not being immersed into any such treating agent, or by a combination of not being immersed and also being protected.

Selected example TSPCD constructions of this invention will be better understood with reference to the following examples:

Example 1—TSPCD Construction

Synthetic diamond powder having an average grain size of approximately 20 micrometers was mixed together for a period of approximately 1 hour by conventional process. The resulting mixture included approximately six percent by volume cobalt solvent metal catalyst, and WC—Co based on the total volume of the mixture, and was cleaned. The mixture was loaded into a refractory metal container with a cemented tungsten carbide substrate and the container was surrounded by pressed salt (NaCl) and this arrangement was placed within a graphite heating element. This graphite heating element containing the pressed salt and the diamond powder/substrate encapsulated in the refractory container was then loaded in a vessel made of a high-temperature/high-pressure self-sealing powdered ceramic material formed by cold pressing into a suitable shape. The self-sealing powdered ceramic vessel was placed in a hydraulic press having one or more rams that press anvils into a central cavity. The press was operated to impose a pressure and temperature condition of approximately 5,500 MPa and approximately 1450° C. on the vessel for a period of approximately 20 minutes During this HPHT processing, the cobalt solvent metal catalyst infiltrated through the diamond powder and catalyzed intercrystalline diamond-to-diamond bonding to form a PCD body having a material microstructure as discussed above and illustrated in FIG. 1. Additionally, the solvent metal catalyst in the substrate infiltrated into the diamond powder mixture to form a bonded attachment with the PCD body, thereby resulting in the formation of a PCD compact. The container was removed from the device, and the resulting PCD compact was removed from the container. Prior to leaching, the PCD compact was finished machined and ground to achieve the desired compact finished dimensions, size and configuration. The resulting PCD compact had a diameter of approximately 16 mm, the PCD diamond body had a thickness of approximately 3 mm, and the substrate had a thickness of approximately 13 mm. The PCD compact had a beveled surface defining a circumferential edge of the upper surface. The PCD compact had a working or cutting surface defined by the upper surface and the beveled edge and a side surface.

A protective fixture as described above was placed concentrically around the outside surface of the compact to cover the substrate and a portion of the diamond body. The fixture was formed from a plastic material capable of surviving exposure to the leaching agent, and included an elastomeric O-ring disposed circumferentially therein around an inside fixture surface adjacent an end of the fixture. The fixture was positioned over the compact so that a portion of the diamond body desired to be rendered thermally stable was exposed therefrom. The O-ring provided a desired seal between the PCD compact and fixture. The PCD compact and fixture assembly was placed with the compact exposed portion immersed into a volume of leaching agent disposed within a suitable container. The leaching agent was a mixture of HF and $HNO_3$ that was provided at a temperature of approximately 22° C.

The depth that the PCD compact was immersed into the leaching agent was a depth sufficient to provide a thermally stable region along the portion of the diamond body comprising the working surfaces, including the upper surface and beveled surface for this particular example. As noted above, if desired, the depth of immersion can be deeper to extend beyond the beveled surface to include a portion of the PCD body side surface extending from the working or cutting surfaces. In this example, the immersion depth was approximately 4 mm. The PCD compact was immersed on the leaching agent for a period of approximately 150 minutes. After the designated treatment time had passed, the PCD compact and fixture assembly were removed from the leaching agent and the compact was removed from the protective fixture.

It is to be understood that the time period for leaching to achieve a desired thermally stable region according to the practice of this invention can and will vary depending on a number of factors, such as the diamond volume density, the diamond grain size, the leaching agent, and the temperature of the leaching agent.

The resulting TSPCD construction formed according to this example had a thermally stable region that extended from the working surfaces a distance into the diamond body of approximately 0.045 mm.

Example 2—TSPCD Construction

A TSPCD construction of this invention was prepared according to the process described above for example 1 except that the treatment for providing a thermally stable region in the PCD body was conducted for longer period of time. Specifically, the PCD compact was immersed on the leaching agent for a period of approximately 300 minutes. After the designated treatment time had passed, the PCD compact and fixture assembly was removed from the leaching agent and PCD compact was removed from the protective fixture. The resulting TSPCD construction formed according to this example had a thermally stable region that extended from the working surfaces a distance into the diamond body of approximately 0.075 mm.

A feature of TSPCD constructions of this invention is that they include a defined thermally stable region within a PCD body that provides an improved degree of wear and abrasion resistance, when compared to conventional PCD, while at the same time providing a desired degree of strength and toughness unique to conventional PCD that has been rendered thermally stable by either removing the catalyst material from a more substantial portion of the diamond body or by removing the catalyst material entirely therefrom. A further feature of TSPCD constructions of this invention is that they include a thermally stable region that extends a determined depth from at least a portion of a working or cutting surface and/or that extends a depth along a side surface the construction, thereby operating to provide a further enhanced degree of thermal stability and resistance during cutting and/or wear service to thereby provide improved service life.

A further feature of TSPCD constructions of this invention is that they can be formed from natural diamond grains that, unlike synthetic diamond grains, do not include catalyst metal and metallic impurities entrapped in the diamond crystals themselves that can limit the extent to which optimal or a desired degree of thermal stability can be achieved by the treatment techniques described above. Accordingly, in certain applications calling for a high degree of thermally stability, the use of natural diamond can be used to achieve this result.

A still farther feature of TSPCD constructions of this invention is that the thermally stable region is formed in a manner that does not adversely impact the compact substrate. Specifically, the treatment process is carefully controlled to ensure that a sufficient region within the PCD body adjacent the substrate remains unaffected and includes the catalyst material, thereby ensuring that the desired bond between the substrate and PCD body remain intact. Additionally, during the treatment process, means are used to protect the surface of the substrate from liquid or vapor contact with the leaching agent, to ensure that the substrate is in no way adversely impacted by the treatment.

A still further feature of TSPCD constructions of this invention is that they are provided in the form of a compact comprising a PCD body, having a thermally stable region, which body is bonded to a metallic substrate. This enables TSPCD constructions of this invention to be attached with different types of well known cutting and wear devices such as drill bits and the like by conventional attachment techniques such as by brazing or welding.

TSPCD constructions of this invention can be used in a number of different applications, such as tools for mining, cutting, machining and construction applications, where the combined properties of thermal stability, wear and abrasion resistance, and strength and toughness are highly desired. TSPCD constructions of this invention are particularly well suited for forming working, wear and/or cutting components in machine tools and drill and mining bits such as roller cone rock bits, percussion or hammer bits, diamond bits, and shear cutters.

Figure 7:
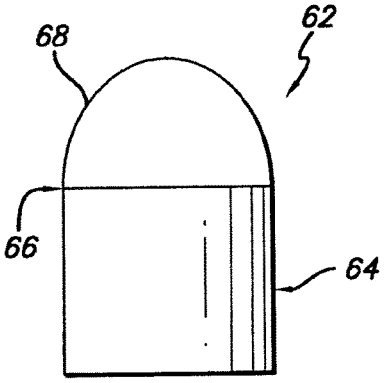
FIG. 7 is a perspective side view of an insert, for use in a roller cone or a hammer drill bit, comprising the thermally stable polycrystalline diamond construction of this invention.

FIG. 7 illustrates an embodiment of a TSPCD construction of this invention provided in the form of an insert 62 used in a wear or cutting application in a roller cone drill bit or percussion or hammer drill bit. For example, such TSPCD inserts 62 are constructed having a substrate portion 64, formed from one or more of the substrate materials disclosed above, that is attached to a PCD body 66 having a thermally stable region. In this particular embodiment, the insert comprises a domed working surface 68, and the thermally stable region is positioned along the working surface and extends a selected depth therefrom into the diamond body. The insert can be pressed or machined into the desired shape or configuration prior to the treatment for rendering the selected region thermally stable. It is to be understood that TSPCD constructions can be used with inserts having geometries other than that specifically described above and illustrated in FIG. 7.

Figure 8:
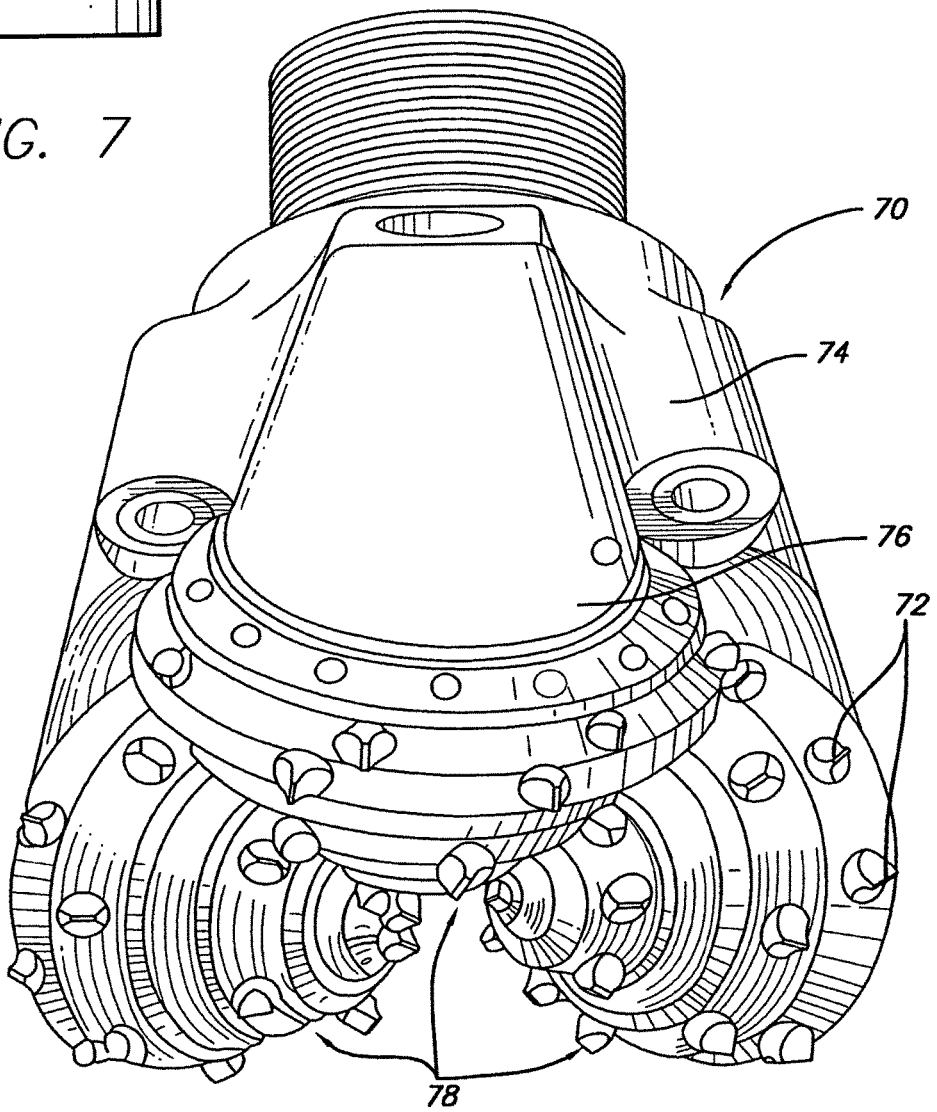
FIG. 8 is a perspective side view of a roller cone drill bit comprising a number of the inserts of FIG. 7.

FIG. 8 illustrates a rotary or roller cone drill bit in the form of a rock bit 70 comprising a number of the wear or cutting TSPCD inserts 72 disclosed above and illustrated in FIG. 7. The rock bit 70 comprises a body 74 having three legs 76 extending therefrom, and a roller cutter cone 78 mounted on a lower end of each leg. The inserts 72 are the same as those described above comprising the TSPCD constructions of this invention, and are provided in the surfaces of each cutter cone 78 for beating on a rock formation being drilled.

Figure 9:
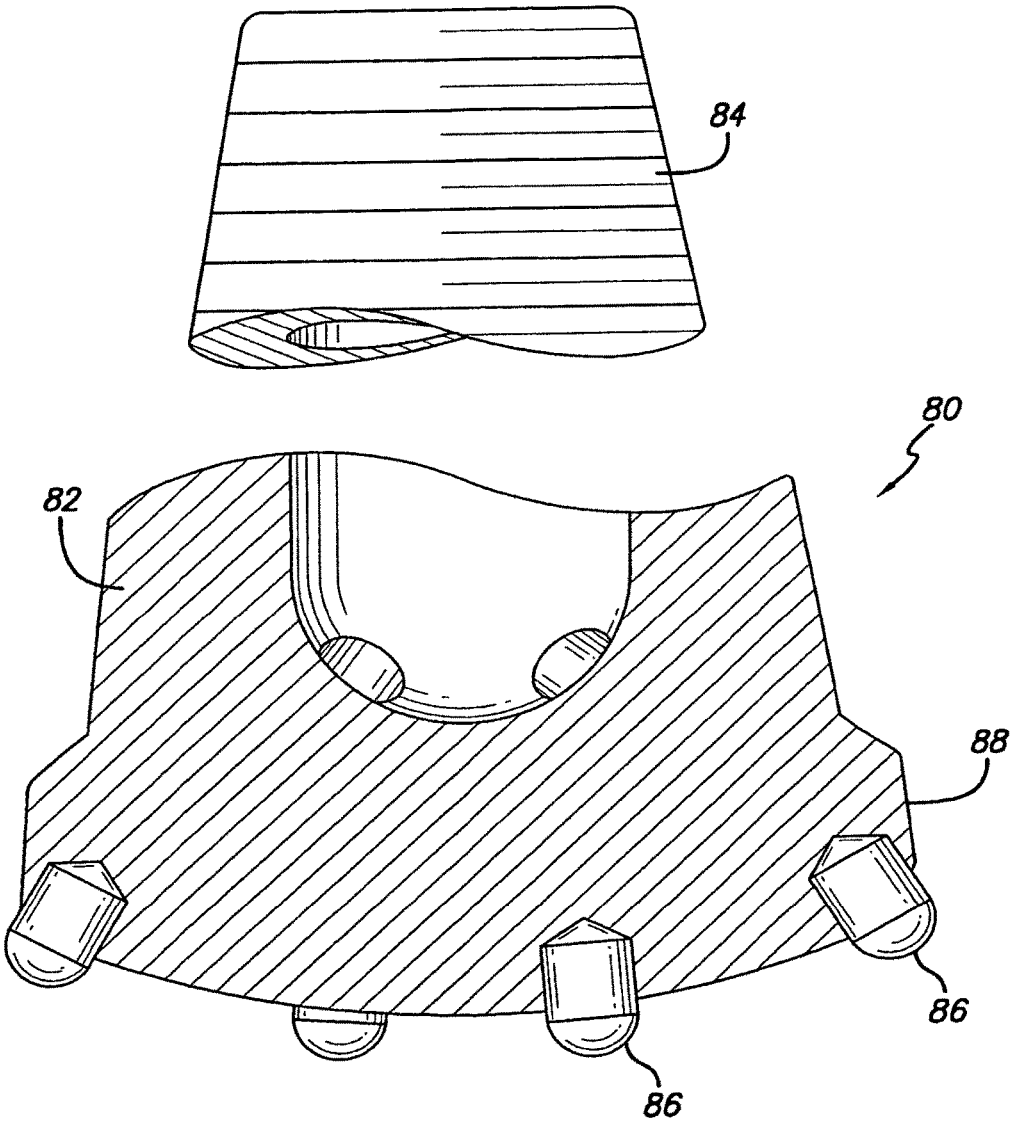
FIG. 9 is a perspective side view of a percussion or hammer bit comprising a number of inserts of FIG. 7.

FIG. 9 illustrates the TSPCD insert described above and illustrated in FIG. 7 as used with a percussion or hammer bit 80. The hammer bit generally comprises a hollow steel body 82 having a threaded pin 84 on an end of the body for assembling the bit onto a drill string (not shown) for drilling oil wells and the like. A plurality of the inserts 86 are provided in the surface of a head 88 of the body 82 for bearing on the subterranean formation being drilled.

FIG. 10 illustrates a TSPCD construction of this invention as embodied in the form of a shear cutter 90 used, for example, with a drag bit for drilling subterranean formations. The TSPCD shear cutter comprises a PCD body 92 that is sintered or otherwise attached to a cutter substrate 94 as described above. The PCD body includes a working or cutting surface 96 that is formed from the thermally stable region of the PCD body. As discussed and illustrated above, the shear cutter working or cutting surface can include the upper surface and a beveled surface defining a circumferential edge of the upper. The shear cutter has a PCD body including a thermally stable region that can extend a depth from such working surfaces and/or a depth from the side surface extending axially a length away from the working surfaces to provide an enhanced degree of thermal stability and thermal resistance to the cutter. It is to be understood that TSPCD constructions can be used with shear cutters having geometries other than that specifically described above and illustrated in FIG. 10.

FIG. 11 illustrates a drag bit 98 comprising a plurality of the TSPCD shear cutters 100 described above and illustrated in FIG. 10. The shear cutters are each attached to blades 102 that extend from a head 104 of the drag bit for cutting against the subterranean formation being chilled. Because the TSPCD shear cutters of this invention include a metallic substrate, they are attached to the blades by conventional method, such as by brazing or welding.

Other modifications and variations of TSPCD constructions as practiced according to the principles of this invention will be apparent to those skilled in the art. It is, therefore, to be understood that within the scope of the appended claims, this invention may be practiced otherwise than as specifically described.

What is claimed is:

1. A method for making a thermally stable polycrystalline diamond construction comprising:

treating a polycrystalline diamond compact comprising a polycrystalline diamond body and a metallic substrate attached thereto, the polycrystalline diamond body comprising a plurality of intercrystalline bonded diamond grains and interstitial regions disposed therebetween, to remove a Group VIII metal from a first region of the diamond body while allowing the Group VIII metal to remain in a second region of the diamond body;

wherein prior to the step of treating, protecting the metallic substrate and a portion of the diamond body from exposure to a treating agent used during the step of treating such that during the step of treating the first region is controlled so that it extends along a length of the side surface that exceeds the depth of the first region at the side surface.

2. The method for making as recited in claim 1 wherein prior to the step of treating, forming the polycrystalline diamond compact comprising subjecting a mixture of diamond grains and Group VIII metal to high-pressure/high-temperature conditions, wherein the diamond grains are formed from natural diamond.

3. The method for making as recited in claim 1 wherein the step of protecting comprises covering the metallic substrate with a protective member and forming a seal between the member and the compact.

4. The method for making as recited in claim 3 wherein the step of protecting comprises providing a leak-tight seal between and outside surface of the compact and an inside surface of a protective fixture that is installed concentrically around the compact.

5. The method for making as recited in claim 1 wherein the second region extends between the first region and the metallic substrate.

6. The method for making as recited in claim 1 wherein the treating step includes exposing the first region of the diamond body to an acid solution selected from the group consisting of HF, HCl, $HNO_3$, and mixtures thereof.

7. The method of making as recited in claim 6 wherein during the step of treating, controlling the depth of the first region so that it extends from an upper surface of the diamond body a depth of not less than about 0.04 mm to a depth of not greater than about 0.08 mm.

8. The method as recited in claim 1 wherein prior to the step of treating, machining the polycrystalline diamond body to a final dimension.

9. A method for making a thermally stable polycrystalline diamond construction comprising a polycrystalline diamond compact having a polycrystalline diamond body and a metallic substrate attached thereto, the polycrystalline diamond body including a plurality of intercrystalline bonded diamond grains and interstitial regions disposed therebetween, the polycrystalline diamond body having an upper surface and a side surface extending a length from the upper surface toward the substrate, the method comprising:

treating the compact to render a first region of the diamond body substantially free of Group VIII metal while allowing the Group VIII metal to remain untreated in a second region of the diamond body, wherein the first region extends a partial depth into the diamond body along a partial length of the side surface, wherein the treating step is performed after the portion of the compact to be treated has been finished to an approximate final dimension.

10. The method of claim 9, wherein the partial length is sufficient to increase the thermal conductivity of the diamond body.

11. The method as recited in claim 9, wherein during the treating step, the compact is treated so that the first region extends a partial depth within the diamond body from at least a portion of the working upper surface.

12. The method of claim 11, wherein the partial depth from the upper surface ranges from about 0.008 to 0.10 mm.

13. The method of claim 12, wherein the partial depth from the upper surface ranges from about 0.04 mm to 0.08 mm.

14. The method as recited in claim 9, wherein before the step of treating, forming the polycrystalline diamond compact using natural diamond grains.

15. The method as recited in claim 9, wherein prior to the step of treating, protecting the metallic substrate and a portion of the diamond body from exposure to a treating agent used during the step of treating such that during the step of treating the first region is controlled so that it extends along a a length of the side surface that exceeds the depth of the first region at the side surface.

16. The method for making as recited in claim 9 wherein prior to the step of treating, forming the polycrystalline diamond compact comprising subjecting a mixture of diamond grains and Group VIII metal to high-pressure/high-temperature conditions, wherein the diamond grains are formed from natural diamond.

17. The method for making as recited in claim 16 wherein the step of protecting comprises covering the metallic substrate with a protective member and forming a seal between the member and the compact.

18. The method for making as recited in claim 17 wherein the step of protecting comprises providing a leak-tight seal between and outside surface of the compact and an inside surface of a protective fixture that is installed concentrically around the compact.

19. The method for making as recited in claim 9 wherein the second region extends between the first region and the metallic substrate.

20. The method for making as recited in claim 9 wherein the treating step includes exposing the first region of the diamond body to an acid solution selected from the group consisting of HF, HCl, $HNO_3$, and mixtures thereof.

* * * * *